US006102220A

United States Patent [19]

Becker

[11] Patent Number: 6,102,220

[45] Date of Patent: Aug. 15, 2000

[54] CRANE JIB

[75] Inventor: Klaus Becker, Wetter, Germany

[73] Assignee: Mannesmann AG, Düsseldorf, Germany

[21] Appl. No.: 09/342,774

[22] Filed: Jun. 29, 1999

[30] Foreign Application Priority Data

Jul. 10, 1998 [DE] Germany ..... 198 32 645

[51] Int. Cl.[7] ..... B66C 23/76

[52] U.S. Cl. ..... 212/196; 212/279

[58] Field of Search ..... 212/196, 279, 212/253, 256, 195, 197, 198, 199

[56] References Cited

U.S. PATENT DOCUMENTS

| | | | |
|---|---|---|---|
| 3,236,391 | 2/1966 | Kennedy | 212/196 |
| 3,247,987 | 4/1966 | Lake | 212/258 |
| 3,340,907 | 9/1967 | Bily | 212/196 |
| 3,743,049 | 7/1973 | Levrini | 212/196 |
| 4,867,321 | 9/1989 | Montgon . | |

FOREIGN PATENT DOCUMENTS

| | | | |
|---|---|---|---|
| 2222572 | 3/1990 | United Kingdom | 212/196 |

*Primary Examiner*—Thomas J. Brahan
*Attorney, Agent, or Firm*—Henry M. Feiereisen

[57] ABSTRACT

A crane jib includes a main boom arranged on a support base for rotation about a vertical pivot axis, and an auxiliary boom extending the main boom at one end and movable with respect to the main boom by means of a first adjustment element. In order to realize a high degree of energy-efficiency and a stable jib at great reach of the jib, a pair of counterweights is provided which are supported at the other one of the ends of the main boom at an angle relative to one another and respectively positioned on both sides of a plane which extends vertically through the longitudinal main boom axis. The counterweights so interconnected to one another as to be swingable in synchronism by a second adjustment. A control device connects the first and second adjustment elements for balancing the variation in reach of the auxiliary boom through a change in reach of the counterweights.

15 Claims, 4 Drawing Sheets

CRANE JIB

CROSS-REFERENCES TO RELATED APPLICATIONS

This application claims the priority of German Patent Application Serial No. 198 32 645.9-22, filed Jul. 10, 1998, the subject matter of which is incorporated herein by reference.

BACKGROUND OF THE INVENTION

The present invention relates, in general, to a crane jib, and more particularly to a crane jib of a type having incorporated therein a device for automatically balancing the crane jib in dependence on the variation of the working radius or reach of the jib.

U.S. Pat. No. 4,867,321, issued Sep. 19, 1989 describes a crane jib of this type which includes a support base for support of a main boom that is rotatable about a vertical pivot axis. The main boom is extendable at one end by an auxiliary boom which is swingable by means of a first adjustment element with respect to the main boom. A counterweight is rotatably supported at the other end of this main boom and swingable by means of a second adjustment element, whereby the adjustment elements are designed as hydraulic cylinders. In order to automatically balance the variation in reach of the auxiliary boom by a change in reach of the counterweight, a connection is provided between the cylinder for pivoting the auxiliary boom and the cylinder for pivoting the counterweight. This conventional crane jib has shortcomings that involve the relatively little use of the applied energy for automatic balancing the variation in reach of the auxiliary boom. Moreover, the stability of the crane deteriorates with increasing reach of the auxiliary boom.

SUMMARY OF THE INVENTION

It is thus an object of the present invention to provide an improved crane jib, obviating the afore-stated drawbacks.

In particular, it is an object of the present invention to provide an improved crane jib that is highly energy-efficient and stable even when the reach of the jib is great.

These objects, and others which will become apparent hereinafter, are attained in accordance with the present invention by providing a main boom defining a longitudinal axis and arranged on a support base for rotation about a vertical pivot axis, an auxiliary boom extending the main boom at one end thereof and movable with respect to the main boom by a first adjustment element to modify the reach of the main boom, a pair of counterweights supported at the other end of the main boom and swingable with respect to the main boom by means of a second adjustment element, said counterweights being disposed relative to one another at an angle on both sides of a plane which extends vertically through the longitudinal axis and swingable in synchronism with respect to one another by the second adjustment element which connects both counterweights, and a device, connecting the first and second adjustment elements, for balancing the variation in reach of the auxiliary boom through movement of the counterweights.

By disposing two counterweights relative to one another at an angle on both sides of a plane which extends vertically through the longitudinal axis and swinging the counterweights in synchronism, a crane jib according to the present invention can be operated at high energy efficiency and better stability at greater spread angle between the counterweights.

Suitably, the device for pivoting the adjustment elements in synchronism is a hydraulic control unit.

According to another feature of the present invention, the first and second adjustment elements may be formed as hydraulic working cylinders.

As far as energetics is concerned, it is suitable when the hydraulic cylinder of the first adjustment element operates like a hydraulic pump to generate a portion of the pressure necessary for actuation of the hydraulic cylinder of the second adjustment element, and vice versa.

The torque of the counterweight can be increased in a simple manner by arranging each of the two counterweights on a rocker lever.

In order to further improve the energy-efficiency, it is proposed to additionally position the counterweights in a slanted relationship with respect to the longitudinal axis at an angle of inclination ranging between 0° and 80°, whereby the angle of inclination may be adjustable by a third adjustment element. This enables a movement of the counterweights in an energetically favorable manner and, at the same time, variations in reach of the auxiliary boom can be fully compensated. Suitably, the third adjustment element is controlled in dependence on the spread angle between the counterweights.

For energetic reasons, it is suitable to move the counterweights on a cylindrical area extending coaxial to the longitudinal axis. A simplification of the counterweight movement can be further realized when each counterweight is swingable about a pivot axis, whereby the pivot axis of one of the counterweights and the pivot axis of the other one of the counterweights extend parallel to one another.

According to another aspect of the present invention, it is suitable to align the counterweights as extension of the longitudinal main boom axis in its longitudinal direction. The angle of inclination is then always smaller than 90°, thereby simplifying the overall construction.

BRIEF DESCRIPTION OF THE DRAWING

The above and other objects, features and advantages of the present invention will now be described in more detail with reference to the accompanying drawing, in which.

DETAILED DESCRIPTION OF PREFERRED EMBODIMENTS

Figure 1:
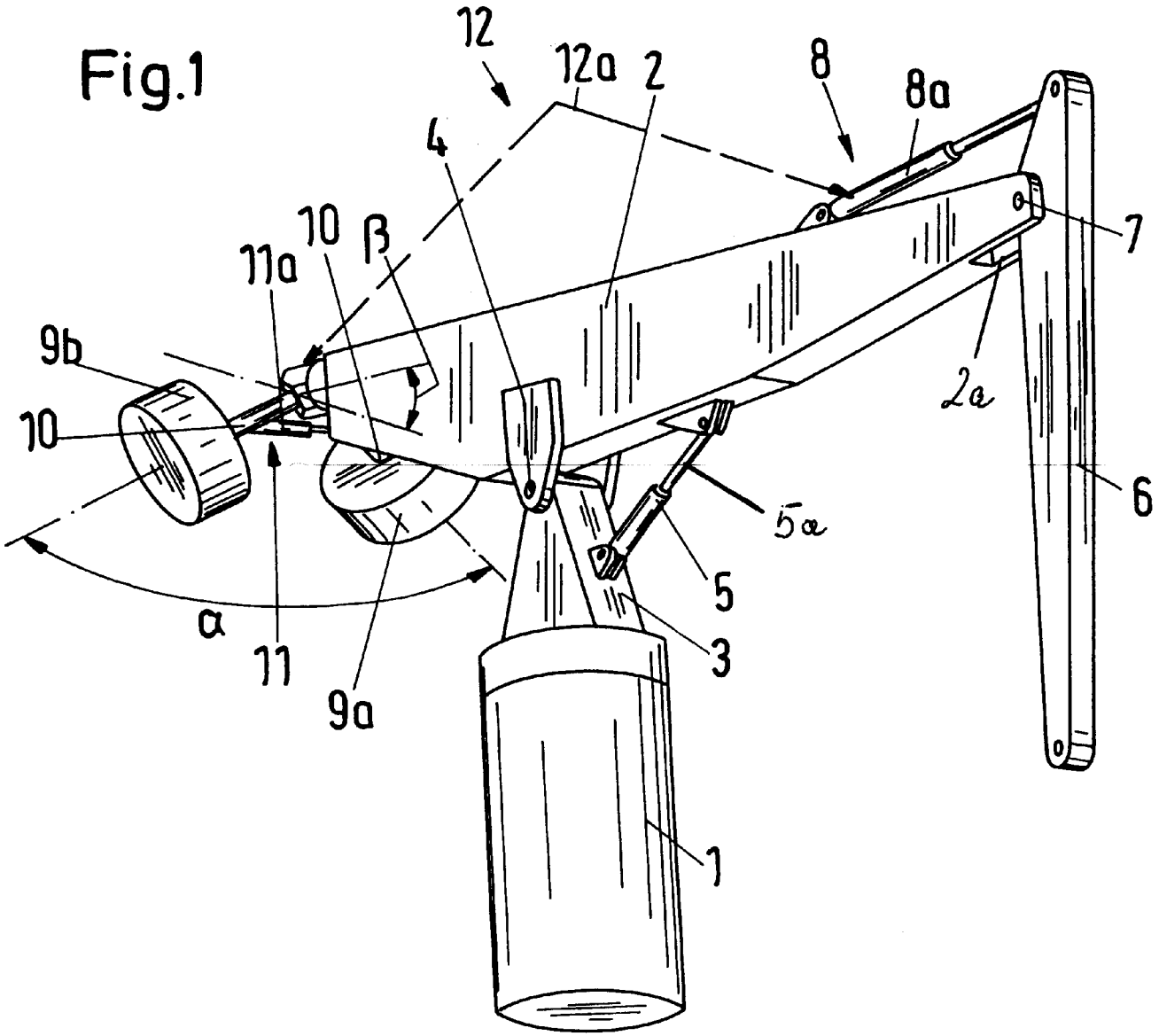
FIG. 1 is a schematic perspective illustration of one embodiment of a crane jib according to the present invention.

Throughout all the Figures, same or corresponding elements are generally indicated by same reference numerals.

Turning now to the drawing, and in particular to FIG. 1, there is shown a schematic perspective illustration of one embodiment of a crane jib according to the present invention, including a vertical support base 1 and a support element or turret 3 secured on the support base 1 for rotation about a vertical axis. The turret 3 supports a horizontal main boom 2 which is swingably mounted to the support base distal end of the turret 3 for rotation about a horizontal pivot axis 4. The swinging motion of the main boom 2 is realized by a hydraulic cylinder 5 which is articulated to the turret 3 and whose rod 5*a* is articulated at its free end to the main boom 2. The main boom 2 has a forward forked end 2*a* for attachment of an auxiliary boom 6 by which the working radius or reach of the main boom 2 can be changed. The auxiliary boom 6 constitutes a head jib in the form of a double-armed rocker lever and is swingably supported by the main boom 2 for rotation about a horizontal axis 7. The auxiliary boom 6 has a front end for support of a grab, hook or other suitable member (not shown), and a rear end for articulation of one end of an adjustment element 8 in the form of a hydraulic working cylinder 8*a*, with the other end of the hydraulic cylinder 8*a* being articulated to the main boom 2. Operation of the hydraulic cylinder 8*a* effects a pivoting of the auxiliary boom 6 about the pivot axis 7 to thereby change the effective length of the main boom 2, viewed in longitudinal direction (from above) thereof, in dependence on the respective pivot angle of the auxiliary boom 6.

As shown in FIG. 1, articulated to the rear end of the main boom 2 are two rocker levers 10, with each one of the rocker levers 10 carrying at the free end thereof a counterweight 9*a*, 9*b*. The two counterweights 9*a*, 9*b* are arranged relative to one another at a spread angle $\alpha$ and respectively positioned on both sides of a vertical plane which extends through the longitudinal axis L defined by the main boom 6 (cf. FIG. 3). In the nonlimiting example of the drawing, the angle $\alpha$ is identical to the angle as defined by the longitudinal extensions of the rocker levers 10.

Persons skilled in the art will understand that the provision of rocker levers 10 for support of the counterweights 9*a*, 9*b* is only one possible configuration. In constructions without rocker levers 10, the angle $\alpha$ is defined by the angle between the imaginary connecting lines which extend through the center of gravity and the pivot point.

Figure 2:
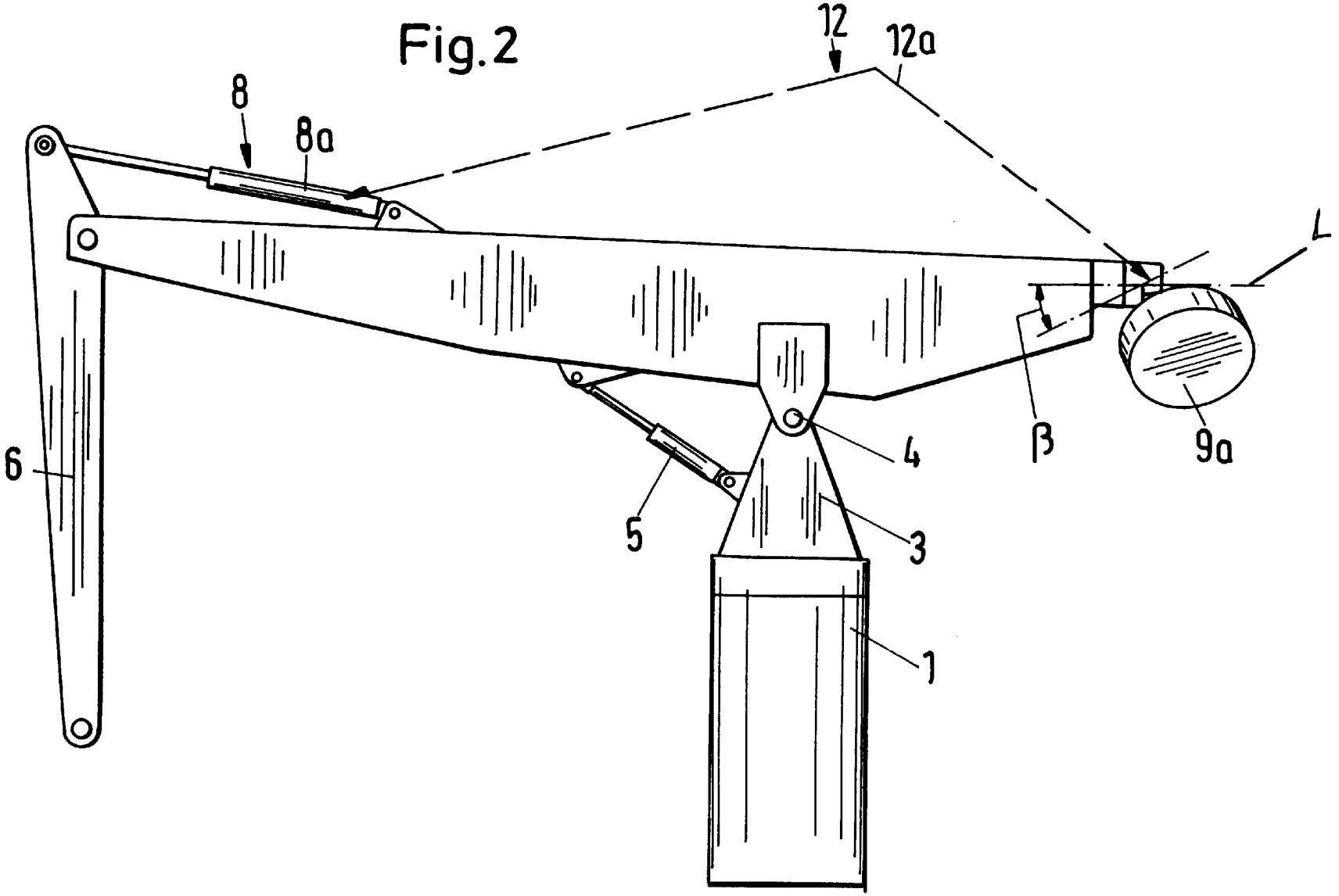
FIG. 2 is a side view of the crane jib of FIG. 1.

Turning now to FIG. 2, which is a side view of the crane jib, it can be seen that the counterweights 9*a*, 9*b* can be disposed at a slanted disposition relative to the longitudinal axis L at an angle of inclination $\beta$ which suitably ranges between 0° and 80°. As shown in particular in FIG. 3, the counterweights 9*a*, 9*b* are connected to one another by a second adjustment element 11, which includes a hydraulic working cylinder 11*a*, so that the counterweights 9*a*, 9*b* are swingable in synchronism about respective pivot axes, whereby both pivot axes extend parallel to one another as well as parallel to the longitudinal axis L. It will be appreciated by persons skilled in the art that both parallel pivot axes may certainly also coincide.

As the rocker levers 10 have a constant length, an oblique disposition during outward swinging or inward swinging of the counterweights 9*a*, 9*b* results in an effective change in length of the main boom 2. This change in length produces a modification of the countertorque which is so adjusted in dependence on a variation in reach of the auxiliary boom 6 that a compensation of this variation of the reach is effected.

Figure 4:
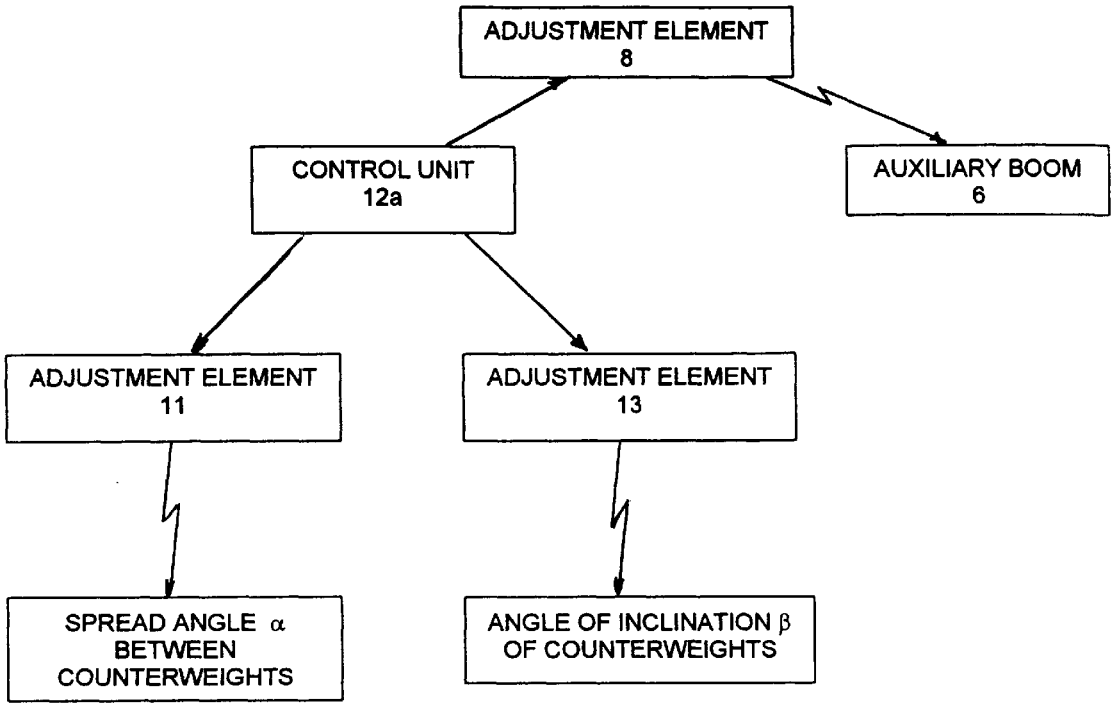
FIG. 4 is a schematic block diagram of a control mechanism for the crane jib of FIG. 1.

The automatic balancing of the variation in reach of the auxiliary boom 6 through respective adjustment of the counterweights 9*a*, 9*b* is controlled by a device, generally designated by reference numeral 12 and including a hydraulic control unit 12*a* which hydraulically connects the first and second adjustment elements 8, 11, as shown in particular in FIG. 4. In the nonlimiting example of the drawing, the control unit 12*a* is so operated that hydraulic fluid of the hydraulic cylinder 8*a* of the first adjustment element 8 generates at least a portion of the pressure required for operating the hydraulic cylinder 11*a* of the second adjustment elements 11, and vice versa, depending on which one of the two working cylinders 8*a*, 11*a* operates as hydraulic pump as a consequence of its movement.

In the simplest case, the control unit 12*a* conducts hydraulic fluid from the one hydraulic cylinder 8*a* or 11*a* into the other hydraulic cylinder 11*a* or 8*a*, preferably from the one plunger chamber of one hydraulic cylinder into the plunger chamber of the other hydraulic cylinder. This is possible when the correlation is linear between the variation in reach of the auxiliary boom 6 and the variation of the reach of the counterweights 9*a*, 9*b* during pivoting of the counterweights 9*a*, 9*b* by means of the hydraulic cylinder 11*a*. Hereby, the parameter of the crane jib must be accordingly selected, i.e. the length of the rocker levers 10, the size of the counterweights 9*a*, 9*b*, the inner diameter of the working cylinder 11*a*, the inner diameter of the working cylinder 8*a*, etc.

It will be appreciated by persons skilled in the art that the device 12 must contain much mechanical apparatus which does not appear in the foregoing Figures, e.g. valves for regulating the fluid flow, fluid reservoirs, connecting lines, etc. However, this apparatus, like much other necessary apparatus, is not part of the invention, and has been omitted from the Figures for the sake of simplicity.

In order to compensate non-linearities, the control unit 12*a* may also include mechanisms to realize a linearization.

Figure 3:
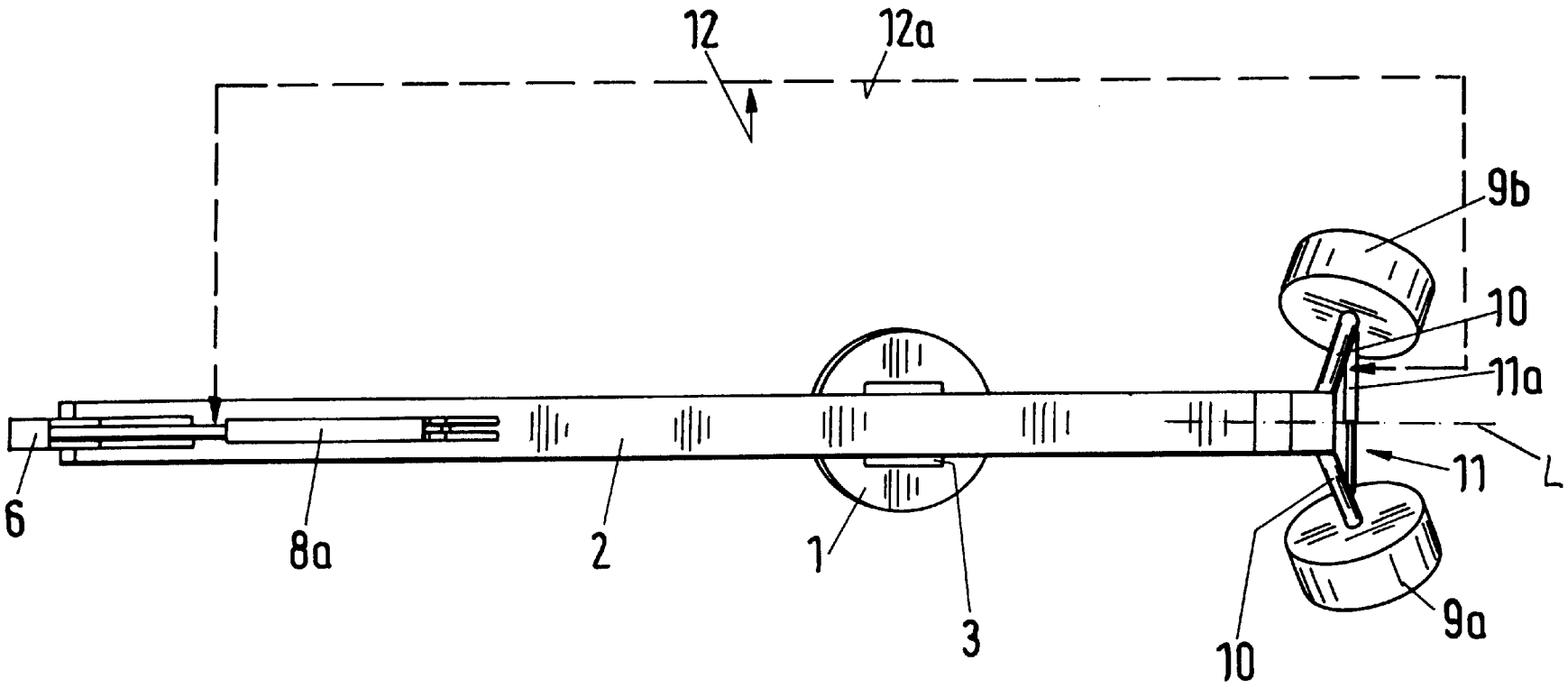
FIG. 3 is a top view of the crane jib of FIG. 1.

As further shown in FIGS. 2 to 4, the angle of inclination $\beta$ may be adjustable by a third adjustment element 13 which may be designed as hydraulic working cylinder as well. The adjustment element 13 is so configured that the angle of inclination $\beta$ is adjustable in dependence on the angle $\alpha$ between the counterweights 9*a*, 9*b*, in accordance with a table-based or formula-based predetermined correlation. Thus, the provision of the adjustment element 13 makes it possible to move the counterweights 9*a*, 9*b* upon a cylindrical area which extends coaxial to the longitudinal axis L, thereby further enhancing the energetic efficiency of the crane jib.

While the invention has been illustrated and described as embodied in a crane jib, it is not intended to be limited to the details shown since various modifications and structural changes may be made without departing in any way from the spirit of the present invention.

What is claimed as new and desired to be protected by Letters Patent is set forth in the appended claims:

What is claimed is:

1. A crane jib, comprising:

a main boom arranged on a support base for rotation about a vertical pivot axis and having opposite axial ends, thereby defining a longitudinal axis;

an auxiliary boom extending the main boom at one of the ends thereof and movable with respect to the main boom by a first adjustment element;

a pair of counterweights supported at the other one of the ends of the main boom and swingable with respect to the main boom by means of a second adjustment element, said counterweights being disposed relative to one another at an angle on both sides of a plane, which extends vertically through the longitudinal axis, and swingable in synchronism with respect to one another by means of the second adjustment element which connects both counterweights;

a device, connecting the first and second adjustment elements, for balancing the variation in reach of the auxiliary boom through a change in reach of the counterweights; and a third adjustment element, each of the counterweights swingable by the third adjustment element about a pivot axis for positioning the counterweights at an angle of inclination with respect to the longitudinal axis, so that, whereby the pivot axis of one of the counterweights and the pivot axis of the other one of the counterweights extend parallel to one another and parallel to the longitudinal axis.

2. The crane jib of claim 1, wherein the device is a hydraulic control unit.

3. The crane jib of claim 1, wherein each of the first and second adjustment elements includes a hydraulic working cylinder.

4. The crane jib of claim 3, wherein the hydraulic cylinder of the first adjustment element operates like a hydraulic pump to generate a portion of the pressure necessary for actuation of the second working cylinder, and vice versa.

5. The crane jib of claim 1, and further comprising two rocker levers, said counterweights being arranged on the rocker levers in one-to-one correspondence.

6. The crane jib of claim 1, wherein the angle of inclination of the counterweights with respect to the longitudinal axis is between 0° and 80°.

7. The crane jib of claim 1, wherein the third adjustment element includes a hydraulic working cylinder.

8. The crane jib of claim 1, wherein the third adjustment element is adjustable in dependence on the angle between the counterweights.

9. The crane jib of claim 1, wherein the counterweights move upon a cylindrical area extending coaxial to the longitudinal axis.

10. A variable reach crane jib, comprising:

a main boom having opposite axial ends, thereby defining a longitudinal axis;

an auxiliary boom extending the main boom at one of the ends thereof;

a first adjustment element interconnecting the main boom and the auxiliary boom for moving the auxiliary boom with respect to the main boom to thereby change the reach of the main boom;

a pair of counterweights supported at the other one of the ends of the main boom and disposed relative to one another at an angle on both sides of a plane which extends vertically through the longitudinal axis, said counterweights being swingable with respect to the main boom;

a second adjustment element interconnecting the counterweights for pivoting the counterweights relative to one another in synchronism;

a control device, connecting the first and second adjustment elements, for balancing the variation in reach of the auxiliary boom through movement of the counterweights; and a third adjustment element operatively connected to the control device, each of the counterweights swingable by the third adjustment element about a pivot axis for positioning the counterweights at an angle of inclination with respect to the longitudinal axis, whereby the pivot axis of one of the counterweights and the pivot axis of the other one of the counterweights extend parallel to one another and parallel to the longitudinal axis.

11. The crane jib of claim 10, wherein each of the first and second adjustment elements includes a hydraulic working cylinder.

12. The crane jib of claim 11, wherein the control device controls a fluid flow to the hydraulic cylinders of the first and second adjustment elements such that the hydraulic cylinder of one of the adjustment elements generates a portion of the pressure necessary for actuation of the hydraulic cylinder of the other one of the adjustment elements, and vice versa.

13. The crane jib of claim 10, wherein the angle of inclination of the counterweights with respect to the longitudinal axis is between 0° and 80°.

14. The crane jib of claim 10, wherein the third adjustment element includes a hydraulic working cylinder.

15. The crane jib of claim 10, wherein the control device controls the third adjustment element in dependence on the angle between the counterweights.

* * * * *